US007820114B2

(12) United States Patent
Amo et al.

(10) Patent No.: US 7,820,114 B2
(45) Date of Patent: Oct. 26, 2010

(54) REACTION CONTAINER FOR CHEMICAL ANALYSIS WITH THE CONTROLLED SURFACE PROPERTY

(75) Inventors: Mina Amo, Hitachi (JP); Takayuki Nakakawaji, Kitaibaraki (JP); Taku Sakazume, Hitachinaka (JP); Katsuhiro Kambara, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 1378 days.

(21) Appl. No.: 10/927,046

(22) Filed: Aug. 27, 2004

(65) Prior Publication Data

US 2005/0047970 A1 Mar. 3, 2005

(30) Foreign Application Priority Data

Sep. 1, 2003 (JP) ..... 2003-308577

(51) Int. Cl.
*B01L 3/00* (2006.01)

(52) U.S. Cl. ..... 422/102; 422/99; 422/130

(58) Field of Classification Search ..... 427/2.11, 427/10, 476, 485, 520, 539, 556; 422/100, 422/102, 292, 919, 922, 936, 942, 130; 453/4; 215/227

See application file for complete search history.

(56) References Cited

U.S. PATENT DOCUMENTS

| | | | | |
|---|---|---|---|---|
| 3,961,899 | A * | 6/1976 | Trivedi et al. | 422/102 |
| 5,023,026 | A | 6/1991 | Yoshida et al. | |
| 5,292,482 | A * | 3/1994 | Manabe | 422/64 |
| 5,831,184 | A * | 11/1998 | Willard et al. | 73/864.91 |
| 6,006,763 | A * | 12/1999 | Mori et al. | 134/1.1 |
| 6,315,738 | B1 | 11/2001 | Nishikawa et al. | |
| 6,764,654 | B2 * | 7/2004 | Sasaki et al. | 422/102 |
| 7,018,963 | B2 * | 3/2006 | Mizusaki et al. | 510/170 |
| 2003/0049183 | A1 * | 3/2003 | Sharma et al. | 422/186.07 |
| 2003/0064005 | A1 | 4/2003 | Sasaki et al. | |
| 2003/0064508 | A1 * | 4/2003 | Kwasnoski et al. | 435/288.4 |
| 2003/0087982 | A1 * | 5/2003 | Kanazawa | 522/49 |
| 2003/0184755 | A1 | 10/2003 | Mori et al. | |
| 2005/0176003 | A1 | 8/2005 | Yokoyama et al. | |

FOREIGN PATENT DOCUMENTS

| | | |
|---|---|---|
| JP | 63-152973 | 6/1988 |
| JP | 5-87805 | 4/1993 |
| JP | 7-270234 | 10/1995 |

(Continued)

*Primary Examiner*—Robert J Hill, Jr.
*Assistant Examiner*—Dwan A Gerido
(74) *Attorney, Agent, or Firm*—Mattingly & Malur, P.C.

(57) ABSTRACT

A highly reliable reaction container capable of restraining an initial detection failure (bubble attachment), and a biochemical and/or immunological automatic analyzer loaded with the reaction container. In a reaction container made of a synthetic resin and used for receiving a biological sample and a reagent, developing a biochemical and/or immunological reaction between the biological sample and the reagent, and measuring proceedings of the reaction and/or the state at a predetermined point in time by optical means, an inner wall surface of the reaction container in contact with the biological sample, the reagent, and a reaction product of the biological sample and the reagent has a critical surface tension of not smaller than 25.0 mN/m, or a contact angle between the inner wall surface of the reaction container and a solvent of a reaction solution is not larger than 60 degrees.

6 Claims, 6 Drawing Sheets

FOREIGN PATENT DOCUMENTS

| | | |
|---|---|---|
| JP | 7-280813 | 10/1995 |
| JP | 2000-346765 | 12/2000 |
| JP | 2001-064867 | 3/2001 |
| JP | 2002-021556 | 1/2002 |
| JP | 2002-90372 | 3/2002 |
| JP | 2002-204939 | 7/2002 |
| JP | 2003-57421 | 2/2003 |
| JP | 2003-098068 | 4/2003 |
| JP | 2003-139781 | 5/2003 |
| JP | 2003-161731 | 6/2003 |
| JP | 2003-240705 | 8/2003 |
| JP | 3457968 | 8/2003 |
| JP | 2003-254981 | 9/2003 |
| JP | 2004-45113 | 2/2004 |
| JP | 2004-045113 | 2/2004 |
| WO | WO 03/024599 | 3/2003 |

* cited by examiner

REACTION CONTAINER FOR CHEMICAL ANALYSIS WITH THE CONTROLLED SURFACE PROPERTY

BACKGROUND OF THE INVENTION

1. Field of the Invention

The present invention relates to a reaction container for chemical analysis with the controlled surface property. More particularly, the present invention relates to a reaction container for use in, e.g., biochemical analysis and/or immunological analysis, a biochemical and/or immunological automatic analyzer loaded with the reaction container, and a method of controlling properties of an inner wall surface of the reaction container.

2. Description of the Related Art

Most of clinical chemical analyses, such as biochemical analysis and immunological analysis of inorganic ions, protein, nitrogen-containing components, carbohydrates, lipid, enzymes, hormones, medicaments, etc. contained in biological samples, e.g., blood and urine, are performed using an automatic analyzer. For example, Patent Reference 1; JP,A 7-280813 discloses one example of the automatic analyzer. The biological sample is a sample which is collected from a body especially suitable for clinical testing.

The number of items to be measured for a biological sample has been drastically increased with improvements in not only performance of biochemical and/or immunological automatic analyzers used in medical institutions, but also in medical inspection technology. The increased number of items to be measured has intensified a demand in the field of biochemical and/or immunological automatic analyzers for higher analysis sensitivity to realize analysis in a smaller amount of a biological sample or a reagent and for a higher processing speed in measurement. From the viewpoint of satisfying such a demand, reliability of a reaction container made of a synthetic resin is very important which is used for developing a reaction between a biological sample and a reagent therein and measuring proceedings of the reaction or the state at a predetermined point in time by optical means.

Problems regarding reliability of the synthetic resin-made reaction container in practical use are as follows;

(1) How to reduce detection failures resulting from stacked bubbles on the inner wall of the reaction container due to higher hydrophobic surface conditions. The jets of the fluid of reagent or sample fluid and/or mixing process g by paddles or other methods having potentials to form the bubbles.

(2) In case to apply a used container after cleaning process for an analysis process, the surface of the container has a potential to keep some components of the sample and/or reagent on the inner wall of the container even after the washing process. These phenomena are called as "Carry over". The cleaning process is designed to keep the carry over level under the detection limit of the system. But the combination of the components and cross reactions among each of the components are not possible to be controlled perfectly in the fluid and reagent. Therefore the carry over will take.

In particular, those problems, i.e., attachment of bubbles and contamination of the container, have recently become more noticeable because of a decrease in the amount of a biological sample used per analysis cycle.

In one reaction container, many kinds of reactions take place successively, and the pH-value of reagents used in the reactions changes over a wide range of from 2 to 13. Also, an acidic or alkaline cleaning liquid and pure water are used in a combined manner for cleaning the reaction container. To increase reliability of the container, therefore, further improvements are required in control of surface properties of the container, in a cleaning method, and so on.

With the view of meeting those requirements, Patent Reference 2; JP,A 2002-90372 proposes a method of using a neutral cleaning liquid to prevent alkali metal soap from remaining in the container, which is produced with reaction between sodium and/or potassium in a detergent and a biological sample or a reagent. Further, Patent Reference 3; JP,A 2003-57421 proposes a method of treating the surface of a saturated cyclic polyolefin resin with discharge plasma in an atmosphere of oxygen or an oxygen-containing gas, thereby introducing a carboxyl group in the resin surface to form a support made of a biochemically active substance. However, effective methods for overcoming the above-mentioned problem (1), i.e., attachment of bubbles to the container inner wall, are not proposed until now.

SUMMARY OF THE INVENTION

Attachment of bubbles to the container inner wall is attributable to low wettability of the inner wall surface. In a container made of an olefin resin and produced by injection molding, because a base material of the container has low wettability in itself and substances added to the base material for molding of the container include an oxidation inhibitor, a lubricant, etc., the surface of the container immediately after being produced exhibits water repellency. A contact angle between the surface of the container made of an olefin resin and water is measured to be about 100 degrees immediately after production of the container. Similarly, a contact angle between the surface of a container made of a polycarbonate resin and water is 65 degrees. A contact angle between the surface of a container made of an acrylic resin and water is 65 degrees. Further, a contact angle between the surface of a container made of a polystyrene resin and water is 88 degrees.

When such a container is loaded in a biochemical automatic analyzer in practical use, a large amount of bubbles attach to an inner wall of the container upon injection of a biological sample and a reagent into the container, and cause an initial detection failure due to, e.g., scattering of light and no passage of light through a target of the measurement. This means the necessity of any solution for preventing bubbles from attaching to the inner wall surface of the container.

It is an object of the present invention to increase reliability of a container having a structure disclosed, for example, in JP, A 2002-204939; JP, A 2003-254981; or JP, A 2004-451113, the disclosures of which are hereby incorporated by reference, by overcoming the above-mentioned problem, particularly, by restraining attachment of bubbles to an inner wall of the container, which are generated when a biological sample, which may be of a liquid or solid phase, and a reagent are injected into the container. Further, the present invention refers to not only biological samples, such as the types analyzed in the medical field of analysis, but also to samples of other types analyzed in other technical fields.

The inventors have accomplished the present invention based on the finding that the above-mentioned problem can be overcome by performing specific ozone treatment on various types of transparent resins.

According to a first aspect of the present invention, there is provided a reaction container made of a synthetic resin, wherein an inner wall surface of the reaction container has a critical surface tension of not smaller than 25.0 mN/m. Also, there is provided a reaction container made of a synthetic resin, wherein a contact angle between the inner wall surface of the reaction container and a solvent of a reaction solution is not larger than 60 degrees. With those features, bubbles generated upon injection of a biological sample and a reagent into the container can be restrained from attaching to the inner wall surface of the container, thus resulting in higher reliability of the reaction container.

A material for use in manufacturing the reaction container is selected from among resin materials having a low water absorption, a low moisture permeability, a high total-light transmittance, a low refractive index, and a low molding shrinkage. As a practical example, the container material is preferably one selected from among a cyclic polyolefin resin, a polycarbonate resin, an acrylic resin, and a polystyrene resin.

According to a second aspect of the present invention, there is provided a biochemical and/or immunological automatic analyzer loaded with the reaction container set forth above. A biochemical and/or immunological automatic analyzer with high reliability can be obtained because the loaded reaction container has the optimally controlled surface property (wettability).

According to a third aspect of the present invention, there is provided a method of controlling properties of an inner wall surface of the reaction container, wherein an inner wall surface of the reaction container is controlled by one or more kinds of ozone treatment selected from among (1) treatment using water in which ozone gas ($O_3$ gas) is dissolved (i.e., ozone water), (2) spray of ozone gas, and (3) ultraviolet-ozone (UV-$O_3$) irradiation such that the inner wall surface of the reaction container has a critical surface tension of not smaller than 25.0 mN/m, or a contact angle between the inner wall surface of the reaction container and a solvent of a reaction solution is not larger than 60 degrees. By employing, as one of the surface property controlling methods, a method of using at least one of the ozone water, the ozone gas, and the ultraviolet-ozone irradiation, the surface property (wettability) can be optimally controlled. It is therefore possible to prevent bubbles from attaching to the inner wall surface and to realize a biochemical reaction container free from detection failures.

Preferably, prior to the treatment using the water in which ozone gas is dissolved (i.e., the ozone water), the inner wall surface of the reaction container is subjected to at least one kind of oxidation treatment selected from among ultraviolet treatment, corona discharge treatment, electron beam treatment, and low- or high-frequency, low-temperature plasma discharge treatment. With such pretreatment, the water in which ozone gas is dissolved (i.e., the ozone water) can be brought into contact with all corners of the reaction container, and the effect of the ozone water treatment can be further increased.

According to a fourth aspect of the present invention, there is provided a biochemical and/or immunological automatic analyzer, wherein the analyzer includes at least one type of ozone treatment apparatus for performing ozone treatment of an inner wall surface of a reaction container made of a synthetic resin and used for analysis, the one type of apparatus being selected from among (1) an apparatus for producing water in which ozone gas is dissolved (i.e., ozone water), (2) an ozone gas sprayer, and (3) an ultraviolet-ozone irradiation apparatus. With this feature, biochemical and/or immunological analysis can be performed in a completely automated manner.

Thus, the present invention can provide a reaction container capable of restraining an initial detection failure (bubble attachment) and being used for a longer term, and a biochemical and/or immunological automatic analyzer loaded with the reaction container.

DESCRIPTION OF THE PREFERRED EMBODIMENTS

Figure 1:
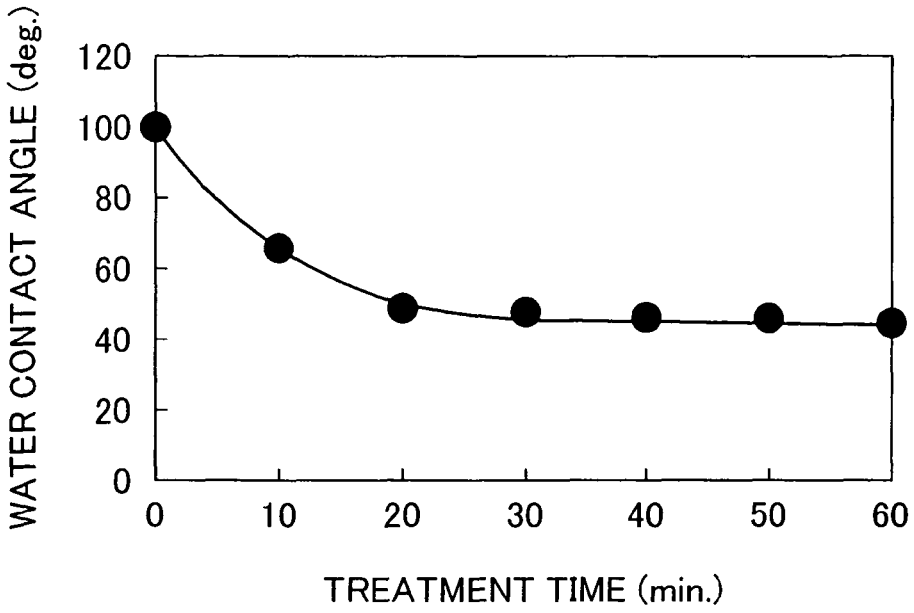
FIG. 1 is a graph showing changes of a water contact angle with respect to a treatment time in Example 1.

A cyclic polyolefin resin used as one of materials for a reaction container of the present invention is a saturated polymer obtained by hydrogenating a sole polymer having a ring-opening olefin structure or a copolymer of cyclic olefin and α-olefin. One preferable example is a hydrogenated ring-opening polymer of norbornene expressed by the following general formula (1):

(1)

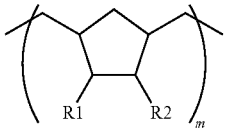

(where R1 and R2 are each the same or different hydrocarbon residue with the hydrogen or carbon number of 1 to 10, and R1 and R2 may form a ring in combination)

The polymer having a structure unit expressed by the general formula (1) is norbornene in the form of a monomer, and an alkyl or alkylidene substitution product thereof. Practical examples of the latter include 5-methyl-2-norbornene, 5,6-dimethyl-2-norbornene, and 5-ethylidene-2-norbornene. Other examples are saturated polymers produced by hydrogenating ring-opening polymers obtained with ring-opening polymerization of dicyclopentadiene, 2,3-dihydrodicyclopentadiene, and alkyl substitution products thereof using methyl, ethyl, etc.

Also, the material of the reaction container may be a polymer of a cyclic olefin monomer expressed by the following general formula (2), or addition copolymers of that monomer and α-olefins, such as ethylene, propylene, isopropylene, 1-buten, 3-methyl-1-butene, 1-pentene and 1-hexene, or saturated polymers produced by hydrogenating ring-opening polymers of the formers:

(2)

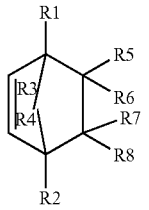

(where R1 to R8 are selected from a group consisted of hydrogen and halogen atoms and hydrocarbon residues, and R5 to R8 may form a ring in any combination)

Further, the material of the reaction container may be a polymer of a cyclic olefin monomer expressed by the following general formula (3), or addition polymers produced by random addition copolymerization of the cyclic olefin monomer expressed by the following general formula (3) with α-olefins, such as ethylene, propylene, isopropylene, 1-buten, 3-methyl-1-butene, 1-pentene and 1-hexene, and α-olefin, or saturated polymers by hydrogenating ring-opening polymers of the formers:

(3)

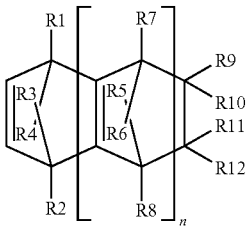

(where R1 to R12 are selected from a group consisted of hydrogen and halogen atoms and hydrocarbon residues, and R9 to R12 may form a ring in any combination)

In the present invention, a base serving as a support for fixing a biochemical active substance is molded by using, as raw materials, one of a polycarbonate resin, an acrylic resin, and a polystyrene resin, etc. in addition to the cyclic polyolefin resins expressed by the above general formulae (1) to (3). The molding method and shape of the base are not limited to particular ones. In consideration of moldability, a preferable molding process is, for example, extrusion, compression molding, injection, emulsion molding.

Any kind of ozone treatment used in the present invention, i.e., (1) treatment using water in which ozone gas ($O_3$ gas) is dissolved (i.e., ozone water), (2) spray of ozone gas, or (3) ultraviolet-ozone (UV-$O_3$) irradiation, has a strong cleaning power attributable to a strong oxidation power of the ozone gas. With that ozone treatment, therefore, an inner wall surface of the biochemical reaction container can be modified all over corners such that surface properties are controlled to have a desired critical surface tension and/or a desired contact angle between the inner wall surface and a reaction solution.

The present invention will be described below in connection with Examples.

Example 1

A reaction container for a biochemical and/or immunological automatic analyzer (hereinafter referred to simply as a "container") was injection molded by using ZEONEX (made by Nippon Zeon Co., Ltd.) as a cyclic polyolefin resin. The molded container had a height of 30 mm, a rectangular opening of 4 mm×6 mm defined by an inner wall of the container, and a wall thickness of 1 mm. The molded container was immersed in ozone water with an ozone concentration of 25 ppm for various periods of treatment time. An ozone water supply unit OM-10L10P made by Sasakura Engineering Co., Ltd. was employed for the ozone water treatment. A flow rate of the ozone water was set to about 1 L/min, and the treatment (immersion) time was set to range from 0 (no treatment) to 60 minutes at maximum. A water contact angle relative to an inner wall surface of the container (hereinafter referred to simply as a "container surface") and a critical surface tension were measured after treatment for each unit period of immersion. The critical surface tension was determined by measuring contact angles between the container surface and diethylene glycol, ethylene glycol and glycerin, other than water, for which respective surface tensions were already known.

Figure 2:
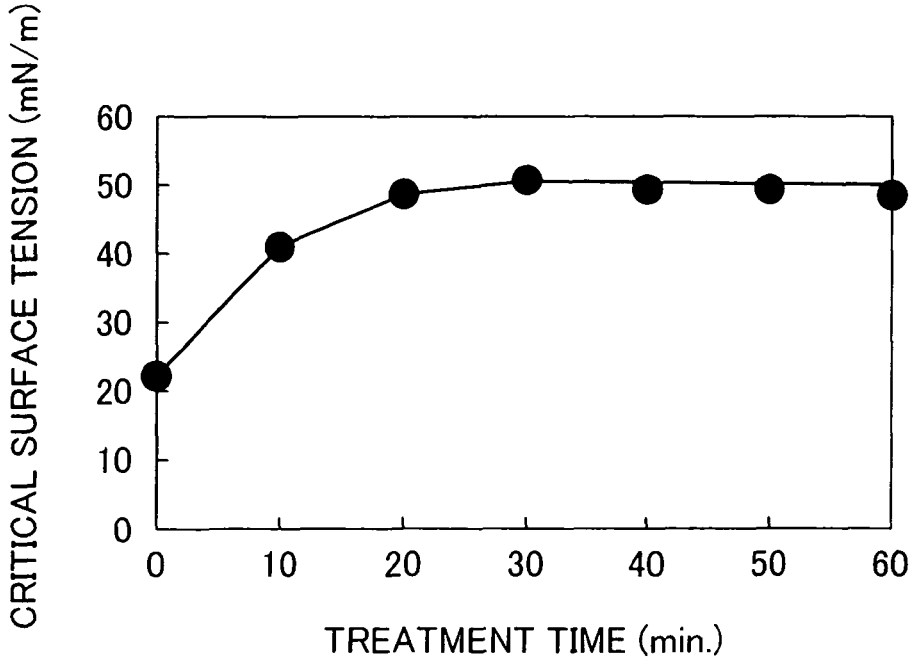
FIG. 2 is a graph showing changes of a critical surface tension with respect to a treatment time in Example 1.

FIG. 1 shows changes of the water contact angle with respect to the treatment time. The contact angle between water and the container surface not yet treated with the ozone water (treatment time of 0 minute) was 100 degrees, while the water contact angle decreased with the progress of the treatment using the ozone water. In other words, the ozone water treatment can greatly increase wettability of the container surface. At the immersion time over 20 minutes, the water contact angle was held constant substantially at 50 degrees. FIG. 2 shows changes of the critical surface tension with respect to the treatment time. As with the water contact angle shown in FIG. 1, an increase of wettability with the ozone water treatment was confirmed.

Then, the container having been subjected to the ozone water treatment was loaded in the biochemical and/or immunological automatic analyzer, and it was checked whether bubble attachment (initial detection failure) occurred upon injection of 200 μl of ion-exchange water. Table 1, given below, shows the contact angle between the container surface and water and the check result of the initial detection failure with respect to each period of the immersion time. Thus, for the container in which the contact angle between the container surface and water was reduced to 60 degrees or below as a result of the above-described treatment, no bubbles attached to the container surface and normal measurement was performed. On the other hand, for the container not yet treated (treatment time of 0 minute) and the container subjected to the ozone water treatment (treatment time of 10 minute), but having the water contact angle of not smaller than 60 degrees, the initial detection failure occurred due to attachment of bubbles and normal measurement was disabled.

TABLE 1

| Treatment Time (min) | Water Contact Angle | Initial Detection Failure (Bubble Attachment) |
|---|---|---|
| 0 (Com. Ex.) | 100° | occurred |
| 10 (Com. Ex.) | 68° | occurred |
| 20 | 52° | not occurred |

TABLE 1-continued

| Treatment Time (min) | Water Contact Angle | Initial Detection Failure (Bubble Attachment) |
|---|---|---|
| 30 | 50° | not occurred |
| 40 | 48° | not occurred |
| 50 | 48° | not occurred |
| 60 | 47° | not occurred |

Example 2

A reaction container for a biochemical and/or immunological automatic analyzer was prepared by using ZEONEX (made by Nippon Zeon Co., Ltd.) in the same manner as in Example 1. In this Example 2, the container was treated by spraying ozone gas to the container surface at a flow rate of 2 L/min. The ozone gas had a concentration of 2.53 g/m$^3$. The treatment time was likewise set as in Example 1 except for periods of 5 and 15 minutes. An ozonizer made by Nomura Electronic Mfg Co., Ltd. was employed as an ozone gas generator.

Figure 3:
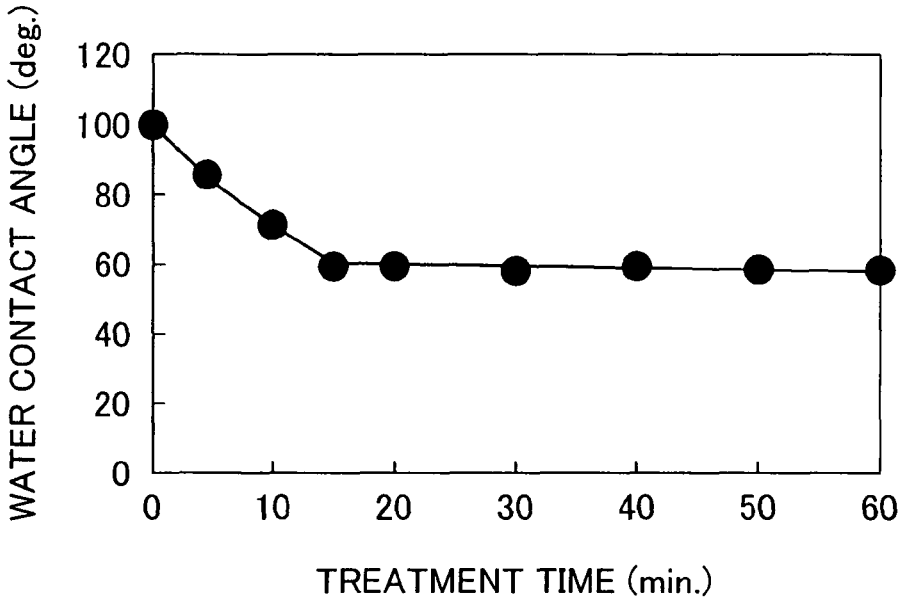
FIG. 3 is a graph showing changes of a water contact angle with respect to a treatment time in Example 2.

FIG. 3 shows changes of the water contact angle with respect to the treatment time. As in Example 1, the contact angle between water and the container surface not yet treated with the ozone gas (treatment time of 0 minute) was 100 degrees, while the water contact angle decreased with the progress of the treatment using the ozone gas. In other words, the ozone gas treatment can greatly increase wettability of the container surface. At the treatment time over 15 minutes, the water contact angle was held constant substantially at 60 degrees.

Then, as in Example 1, the container having been subjected to the ozone gas treatment was loaded in the biochemical and/or immunological automatic analyzer, and it was checked whether bubble attachment (initial detection failure) occurred upon injection of 200 μl of ion-exchange water. Table 2, given below, shows the contact angle between the container surface and water and the check result of the initial detection failure with respect to each period of the treatment time. Thus, as in Example 1, for the container in which the contact angle between the container surface and water was reduced to 60 degrees or below, no bubbles attached to the container surface and normal measurement was performed. On the other hand, for the containers subjected to the ozone gas treatment (treatment time of 5 and 10 minute), but having the water contact angle of not smaller than 60 degrees, the initial detection failure occurred due to attachment of bubbles.

TABLE 2

| Treatment Time (min) | Water Contact Angle | Initial Detection Failure (Bubble Attachment) |
|---|---|---|
| 0 (Com. Ex.) | 100° | occurred |
| 5 (Com. Ex.) | 84° | occurred |
| 10 (Com. Ex.) | 72° | occurred |
| 15 | 60° | not occurred |
| 20 | 60° | not occurred |
| 30 | 59° | not occurred |
| 40 | 60° | not occurred |
| 50 | 59° | not occurred |
| 60 | 59° | not occurred |

Example 3

A reaction container for a biochemical and/or immunological automatic analyzer was prepared by using ZEONEX (made by Nippon Zeon Co., Ltd.) in the same manner as in Examples 1 and 2. In this Example 3, the container was treated by irradiating ultraviolet rays (UV-ozone) to the container surface. An ultraviolet irradiation device (UV-208 made by Technovision, Inc.) was used in the treatment. This irradiation device generated ozone as well so that the container surface was exposed to a high-concentration ozone atmosphere along with the UV irradiation. The treatment time was likewise set as in Example 1 except for periods of 5 and 15 minutes.

Figure 4:
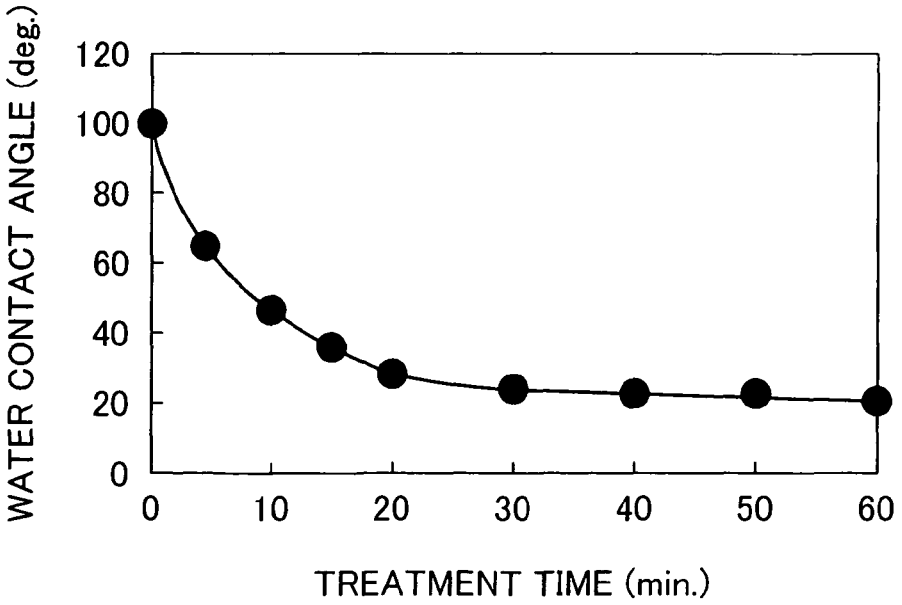
FIG. 4 is a graph showing changes of a water contact angle with respect to a treatment time in Example 3.

FIG. 4 shows changes of the water contact angle with respect to the treatment time. As in Examples 1 and 2, the contact angle between water and the container surface not yet treated with the UV-ozone irradiation (treatment time of 0 minute) was 100 degrees, while the water contact angle decreased with the progress of the treatment using the UV-ozone irradiation. In other words, the UV-ozone treatment can greatly increase wettability of the container surface. At the treatment time of 5 minutes, the water contact angle was 60 degrees, and after the 60-minute treatment, it was reduced to 20 degrees.

Then, as in Examples 1 and 2, the container having been subjected to the UV-ozone treatment was loaded in the biochemical and/or immunological automatic analyzer, and it was checked whether bubble attachment (initial detection failure) occurred upon injection of 200 μl of ion-exchange water. Table 3, given below, shows the contact angle between the container surface and water and the check result of the initial detection failure with respect to each period of the treatment time. Thus, as in Example 1, for the container in which the contact angle between the container surface and water was reduced to 60 degrees or below, no bubbles attached to the container surface and normal measurement was performed. On the other hand, for the container subjected to the UV-ozone treatment (treatment time of 5 minute), but having the water contact angle of not smaller than 60 degrees, the initial detection failure occurred due to attachment of bubbles.

TABLE 3

| Treatment Time (min) | Water Contact Angle | Initial Detection Failure (Bubble Attachment) |
|---|---|---|
| 0 (Com. Ex.) | 100° | occurred |
| 5 (Com. Ex.) | 64° | occurred |
| 10 | 46° | not occurred |
| 15 | 38° | not occurred |
| 20 | 28° | not occurred |
| 30 | 24° | not occurred |
| 40 | 22° | not occurred |
| 50 | 21° | not occurred |
| 60 | 20° | not occurred |

Example 4

A reaction container for a biochemical and/or immunological automatic analyzer was prepared by using ZEONEX (made by Nippon Zeon Co., Ltd.) in the same manner as in Examples 1, 2 and 3. In this Example 4, after performing the UV-ozone treatment, as in Example 3, for 5 minutes, the container was immersed in the ozone water as in Example 1. The treatment time during which the container was immersed in the ozone water was likewise set as in Example 1. The ozone water had a concentration of 20 ppm.

Figure 5:
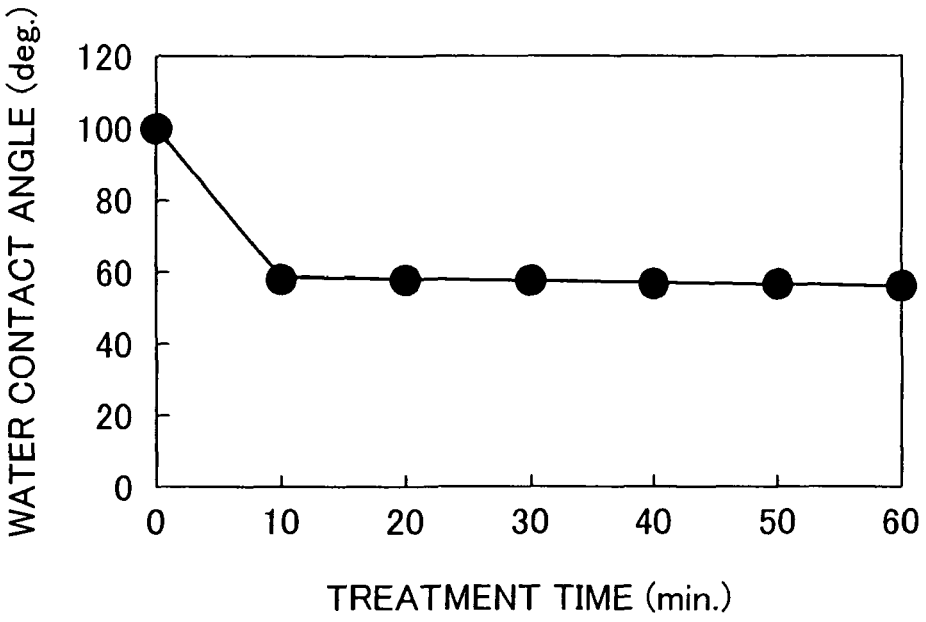
FIG. 5 is a graph showing changes of a water contact angle with respect to a treatment time in Example 4.

FIG. 5 shows changes of the water contact angle with respect to the treatment time. As in Example 1, the contact angle between water and the container surface treated with neither the UV-ozone irradiation nor immersion in the ozone water (treatment time of 0 minute) was 100 degrees, while the water contact angle decreased with the progress of the UV-ozone treatment and the ozone water treatment. In other words, the ozone treatment can greatly increase wettability of the container surface. At the treatment time over 10 minutes, the water contact angle was held constant substantially at 60 degrees.

Then, as in Example 1, the container having been subjected to the UV-ozone treatment and the ozone water treatment was loaded in the biochemical and/or immunological automatic analyzer, and it was checked whether bubble attachment (initial detection failure) occurred upon injection of 200 μl of ion-exchange water. Table 4, given below, shows the contact angle between the container surface and water and the check result of the initial detection failure with respect to each period of the treatment time. Thus, as in Example 1, for the container in which the contact angle between the container surface and water was reduced to 60 degrees or below, no bubbles attached to the container surface and normal measurement was performed. On the other hand, for the container not yet treated, the initial detection failure occurred due to attachment of bubbles.

TABLE 4

| Treatment Time (min) | Water Contact Angle | Initial Detection Failure (Bubble Attachment) |
|---|---|---|
| 0 (Com. Ex.) | 100° | occurred |
| 10 | 59° | not occurred |
| 20 | 59° | not occurred |
| 30 | 59° | not occurred |
| 40 | 58° | not occurred |
| 50 | 58° | not occurred |
| 60 | 57° | not occurred |

Example 5

A reaction container for a biochemical and/or immunological automatic analyzer was prepared by using a polycarbonate resin (CALIBRE 301-15 made by Sumitomo Dow Limited) instead of ZEONEX (made by Nippon Zeon Co., Ltd.) used in Examples 1, 2 and 3. In this Example 5, the container was subjected to each kind of ozone treatment, i.e., the ozone water treatment as in Example 1, the ozone gas spray as in Example 2, and the UV-ozone treatment as in Example 3. In the ozone water treatment, an ozone water supply unit OM-2 made by Sasakura Engineering Co., Ltd. was employed, and the ozone water had an ozone concentration of 25 ppm. In the ozone gas spray, an ozonizer made by Nomura Electronic Mfg Co., Ltd. was employed, and the ozone gas had a flow rate of 2 L/min and a concentration of 2.53 g/m$^3$. In the UV-ozone treatment, an ultraviolet irradiation device (UV-208 made by Technovision, Inc.) was employed so that the container surface was exposed to a high-concentration ozone atmosphere along with the UV irradiation.

Figure 6:
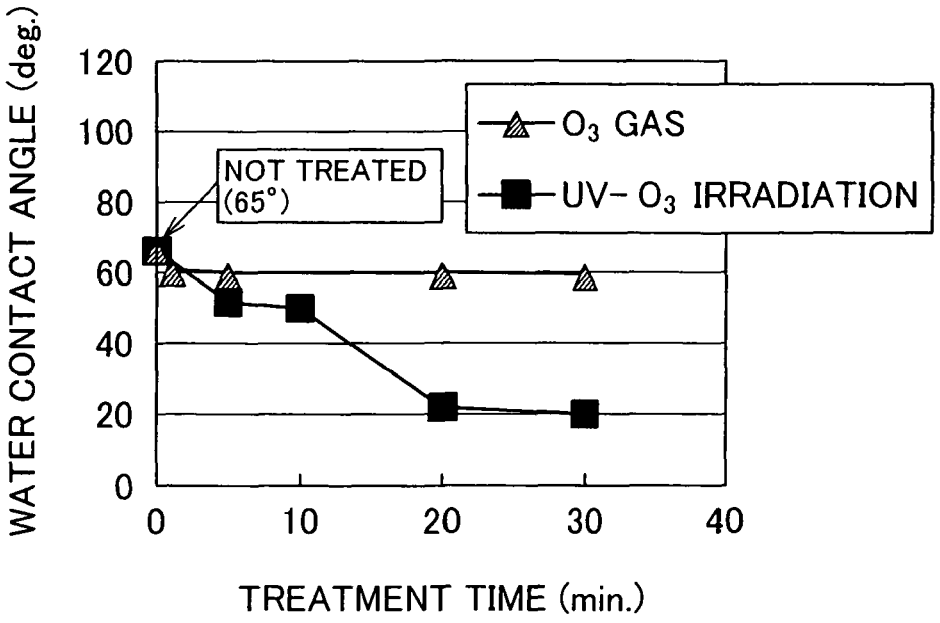
FIG. 6 is a graph showing changes of a water contact angle with respect to a treatment time in Example 5.

FIG. 6 shows changes of the water contact angle with respect to the treatment time. As with the ozone water treatment in Example 1, the ozone gas spray in Example 2, and the UV-ozone treatment in Example 3, the contact angle between water and the container surface not yet subjected to any ozone treatment (treatment time of 0 minute) was relatively high, while the water contact angle decreased with the progress of the ozone treatment. In other words, the ozone treatment can also greatly increase wettability of the surface of the container made of a polycarbonate resin.

Then, the container having been subjected to each ozone treatment was loaded in the biochemical and/or immunological automatic analyzer, and it was checked whether bubble attachment (initial detection failure) occurred upon injection of 200 μl of ion-exchange water. For the container in which the contact angle between the container surface and water was reduced to 60 degrees or below as a result of the ozone treatment, no bubbles attached to the container surface and normal measurement was performed. On the other hand, for the container not yet treated (treatment time of 0 minute) and the container subjected to the ozone treatment (treatment time of 10 minute), but having the water contact angle of not smaller than 60 degrees, the initial detection failure occurred due to attachment of bubbles and normal measurement was disabled.

Example 6

A reaction container for a biochemical and/or immunological automatic analyzer was prepared by using an acrylic resin (PARAPET GH made by Kuraray Co., Ltd.) instead of ZEONEX (made by Nippon Zeon Co., Ltd.) used in Examples 1, 2 and 3. In this Example 6, the container was subjected to each kind of ozone treatment, i.e., the ozone water treatment as in Example 1, the ozone gas spray as in Example 2, and the UV-ozone treatment as in Example 3. In the ozone water treatment, an ozone water supply unit OM-2 made by Sasakura Engineering Co., Ltd. was employed, and the ozone water had an ozone concentration of 25 ppm. In the ozone gas spray, an ozonizer made by Nomura Electronic Mfg Co., Ltd. was employed, and the ozone gas had a flow rate of 2 L/min and a concentration of 2.53 g/m$^3$. In the UV-ozone treatment, an ultraviolet irradiation device (UV-208 made by Technovision, Inc.) was employed so that the container surface was exposed to a high-concentration ozone atmosphere along with the UV irradiation.

Figure 7:
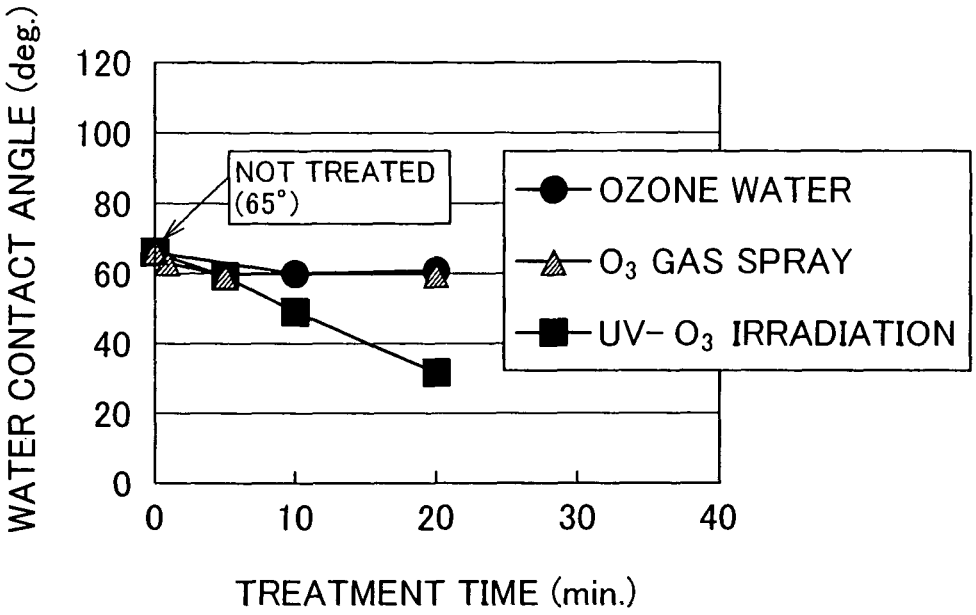
FIG. 7 is a graph showing changes of a water contact angle with respect to a treatment time in Example 6.

FIG. 7 shows changes of the water contact angle with respect to the treatment time. As with the ozone water treatment in Example 1, the ozone gas spray in Example 2, and the UV-ozone treatment in Example 3, the contact angle between water and the container surface not yet subjected to any ozone treatment (treatment time of 0 minute) was relatively high, while the water contact angle decreased with the progress of the ozone treatment. In other words, the ozone treatment can also greatly increase wettability of the surface of the container made of an acrylic resin.

Then, the container having been subjected to each ozone treatment was loaded in the biochemical and/or immunological automatic analyzer, and it was checked whether bubble attachment (initial detection failure) occurred upon injection of 200 μl of ion-exchange water. For the container in which the contact angle between the container surface and water was reduced to 60 degrees or below as a result of the ozone treatment, no bubbles attached to the container surface and normal measurement was performed. On the other hand, for the container not yet treated (treatment time of 0 minute) and the container subjected to the ozone treatment (treatment time of 10 minute), but having the water contact angle of not smaller than 60 degrees, the initial detection failure occurred due to attachment of bubbles and normal measurement was disabled.

Example 7

A reaction container for a biochemical and/or immunological automatic analyzer was prepared by using an polystyrene resin (DIC Styrene CR2500 made by Dainippon Ink and Chemicals, Inc.) instead of ZEONEX (made by Nippon Zeon Co., Ltd.) used in Examples 1, 2 and 3. In this Example 7, the container was subjected to each kind of ozone treatment, i.e., the ozone water treatment as in Example 1, the ozone gas spray as in Example 2, and the UV-ozone treatment as in Example 3. In the ozone water treatment, an ozone water supply unit OM-2 made by Sasakura Engineering Co., Ltd. was employed, and the ozone water had an ozone concentration of 25 ppm. In the ozone gas spray, an ozonizer made by Nomura Electronic Mfg Co., Ltd. was employed, and the ozone gas had a flow rate of 2 L/min and a concentration of 2.53 g/m$^3$. In the UV-ozone treatment, an ultraviolet irradiation device (UV-208 made by Technovision, Inc.) was employed so that the container surface was exposed to a high-concentration ozone atmosphere along with the UV irradiation.

Figure 8:
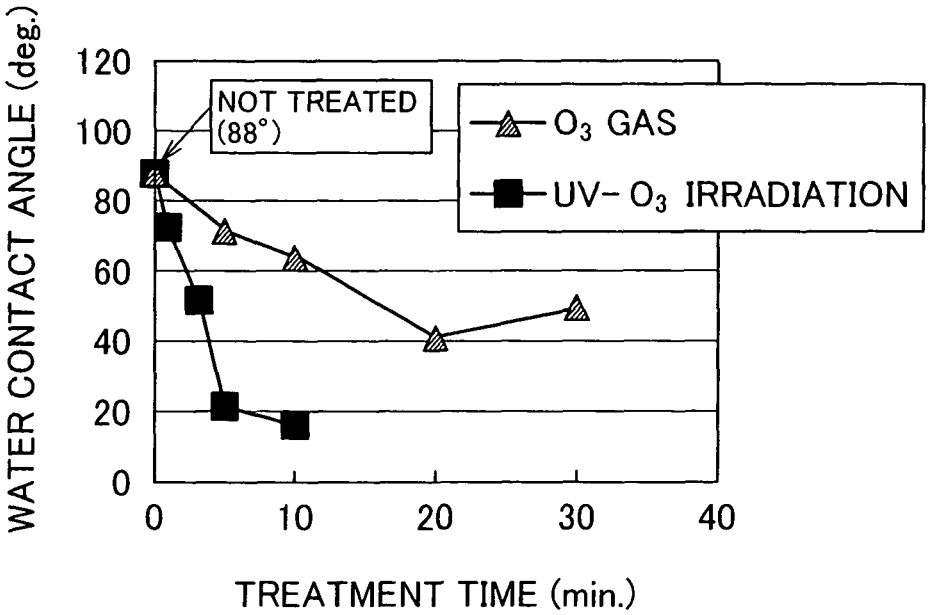
FIG. 8 is a graph showing changes of a water contact angle with respect to a treatment time in Example 7.

FIG. 8 shows changes of the water contact angle with respect to the treatment time. As with the ozone water treatment in Example 1, the ozone gas spray in Example 2, and the UV-ozone treatment in Example 3, the contact angle between water and the container surface not yet subjected to any ozone treatment (treatment time of 0 minute) was relatively high, while the water contact angle decreased with the progress of the ozone treatment. In other words, the ozone treatment can also greatly increase wettability of the surface of the container made of a polystyrene resin.

Then, the container having been subjected to each ozone treatment was loaded in the biochemical and/or immunological automatic analyzer, and it was checked whether bubble attachment (initial detection failure) occurred upon injection of 200 μl of ion-exchange water. For the container in which the contact angle between the container surface and water was reduced to 60 degrees or below as a result of the ozone treatment, no bubbles attached to the container surface and normal measurement was performed. On the other hand, for the container not yet treated (treatment time of 0 minute) and the container subjected to the ozone treatment (treatment time of 10 minute), but having the water contact angle of not smaller than 60 degrees, the initial detection failure occurred due to attachment of bubbles and normal measurement was disabled.

Example 8

A reaction container for a biochemical and/or immunological automatic analyzer (hereinafter referred to simply as a "container") was prepared by using ZEONEX (made by Nippon Zeon Co., Ltd.) in the same manner as in Example 1. In this Example 8, the molded container was immersed in ozone water with an ozone concentration of 25 ppm for various periods of treatment time. An ozone water supply unit OM-10L10P made by Sasakura Engineering Co., Ltd. was employed for the ozone water treatment. A flow rate of the ozone water was set to about 1 L/min, and the treatment (immersion) time was set to range from 0 (no treatment) to 30 minutes at maximum. Then, the treated container was measured for an O (Oxygen)—1s narrow scan spectrum with an X-ray photon spectroscopic analyzer. Quantera SXM made by Physical Electronics Co. was employed as the X-ray photon spectroscopic analyzer, and measurement conditions were set as follows: attainable vacuum degree; $1.9\times10^{-8}$ Pa, spectroscope; electrostatic concentric hemispherical type, amplifier; multi-channel type (32 Multi-Channel Detector), and X-ray usage conditions including X-ray; Al K α-ray, excitation energy; 1486.6 eV (100.6 W), and neutralization gun power; 1.1 V (10 μA).

Figure 9:
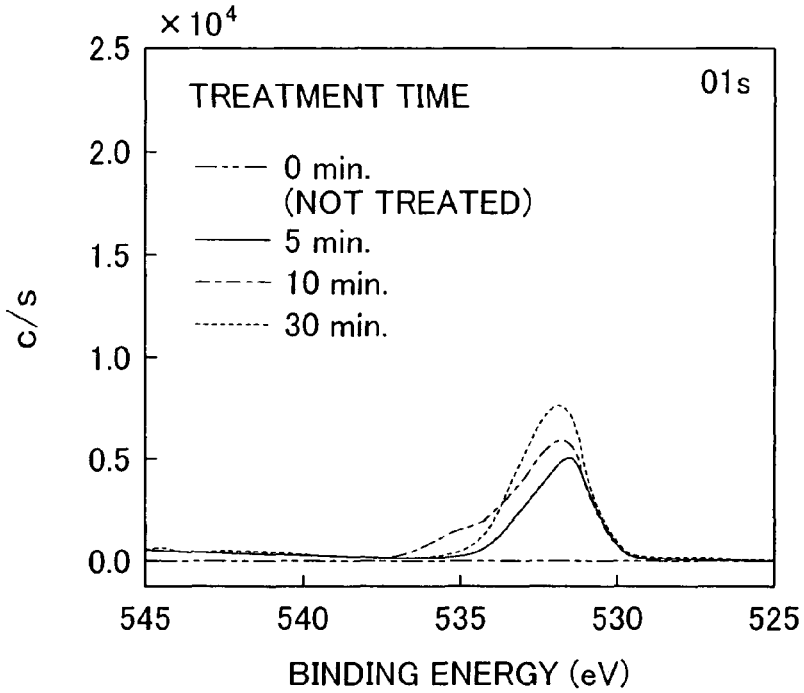
FIG. 9 is a graph showing an O1s narrow scan spectrum of a container surface having been subjected to ozone water treatment.

FIG. 9 shows the O1s narrow scan spectrum of the container surface having been subjected to the ozone water treatment. No O1s peak was detected for the container surface not yet treated, while the intensity of the O1s peak increased with the progress of the ozone water treatment. The detection of the O1s peak indicates the presence of, e.g., a hydroxyl group (—OH) having hydrophilic property in the container surface. It was hence confirmed that the container surface was modified to have hydrophilic property with the ozone water treatment.

Example 9

A reaction container for a biochemical and/or immunological automatic analyzer (hereinafter referred to simply as a "container") was prepared by using ZEONEX (made by Nippon Zeon Co., Ltd.) in the same manner as in Example 8. In this Example 9, the container was treated performed by spraying ozone gas to the container surface at a flow rate of 2 L/min. The ozone gas had a concentration of 2.53 g/m$^3$. The treatment time was likewise set as in Example 8. An ozonizer made by Nomura Electronic Mfg Co., Ltd. was employed as an ozone gas generator. Then, the treated container was measured for an O (Oxygen)—1s narrow scan spectrum with an X-ray photon spectroscopic analyzer. Measurement conditions were the same as those in Example 8.

Figure 10:
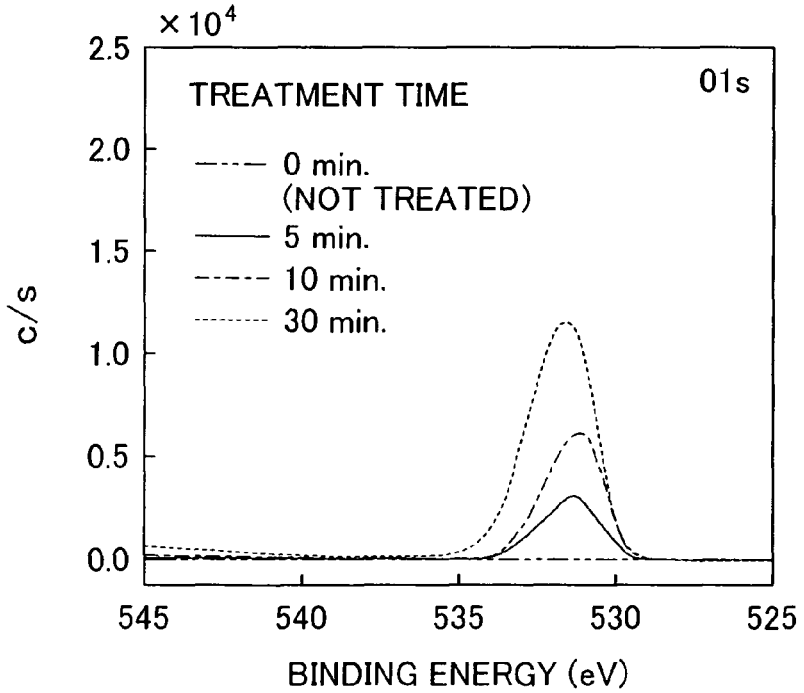
FIG. 10 is a graph showing an O1s narrow scan spectrum of a container surface having been subjected to ozone gas treatment.

FIG. 10 shows the O1s narrow scan spectrum of the container surface having been subjected to the ozone gas treatment. No O1s peak was detected for the container surface not yet treated, while the intensity of the O1s peak increased with the progress of the ozone gas treatment. The detection of the O1s peak indicates the presence of, e.g., a hydroxyl group having hydrophilic property in the container surface. It was hence confirmed that the container surface was modified to have hydrophilic property with the ozone gas treatment.

Example 10

A reaction container for a biochemical and/or immunological automatic analyzer (hereinafter referred to simply as a "container") was prepared by using ZEONEX (made by Nippon Zeon Co., Ltd.) in the same manner as in Example 8. In this Example 10, the container was treated by irradiating ultraviolet rays (UV-ozone) to the container surface. An ultraviolet irradiation device (UV-208 made by Technovision, Inc.) was used in the treatment. This irradiation device generated ozone as well so that the container surface was exposed to a high-concentration ozone atmosphere along with the UV irradiation. The treatment time was likewise set as in Example 8. Then, the treated container was measured for an O (Oxygen)—1s narrow scan spectrum with an X-ray photon spectroscopic analyzer. Measurement conditions were the same as those in Example 8.

Figure 11:
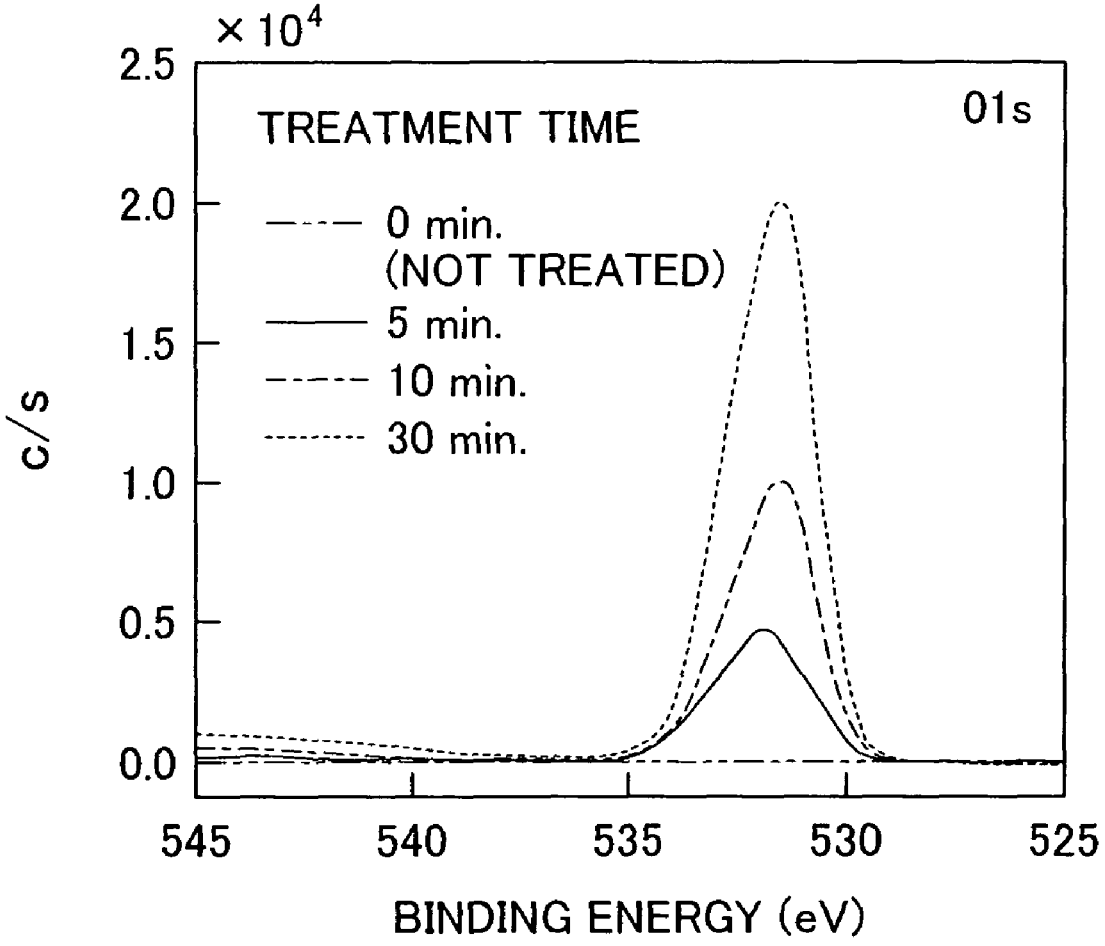
FIG. 11 is a graph showing an O1s narrow scan spectrum of a container surface having been subjected to UV-ozone treatment.

FIG. 11 shows the O1s narrow scan spectrum of the container surface having been subjected to the UV-ozone water treatment. No O1s peak was detected for the container surface not yet treated, while the intensity of the O1s peak increased with the progress of the UV-ozone treatment. The detection of the O1s peak indicates the presence of, e.g., a hydroxyl group having hydrophilic property in the container surface. It was hence confirmed that the container surface was modified to have hydrophilic property with the UV-ozone treatment.

What is claimed is:

1. A reaction container made of a cyclic polyolefin resin and used for receiving a biological sample and a reagent, developing a reaction between said biological sample and said reagent, and measuring proceedings of said reaction and/or the state at a predetermined point in time by optical means, said reaction container having interior walls in which a liquid is contained;

wherein a surface of said interior walls of said reaction container contacts with said biological sample, said reagent, and a reaction product of said biological sample and said reagent, and a critical surface tension of said surface of said interior walls is larger than or equal to 25.0 mN/m.

2. A biochemical and/or immunological automatic analyzer loaded with a reaction container according to claim 1.

3. A reaction container made of a cyclic polyolefin resin and used for receiving a biological sample and a reagent, developing a reaction between the biological sample and the reagent, and measuring proceedings of the reaction and/or the state at a predetermined point in time by optical means, said reaction container having interior walls in which a liquid is contained;

wherein a contact angle between a surface of said interior walls of said reaction container and a solvent of a reaction solution is not larger than 60 degrees.

4. A method of controlling properties of an inner wall surface of a reaction container, which is made of a cyclic polyolefin resin and used for receiving a biological sample and a reagent, developing a biochemical and/or immunological reaction between the biological sample and the reagent, and measuring proceedings of the reaction and/or the state at a predetermined point in time by optical means, said reaction container having interior walls in which a liquid is contained;

wherein a surface of said interior walls of said reaction container is controlled by one or more kinds of ozone treatment selected from among (1) treatment using water in which ozone gas is dissolved, (2) spray of ozone gas, and (3) ultraviolet-ozone irradiation such that the inner wall surface of the reaction container has a critical surface tension of not smaller than 25.0 mN/m, or a contact angle between the surface of the interior walls of the reaction container and a solvent of a reaction solution is not larger than 60 degrees.

5. A method of controlling properties of an inner wall surface of a reaction container according to claim 4, wherein prior to the treatment using the water in which ozone gas is dissolved, the surface of the interior walls of said reaction container is subjected to at least one kind of oxidation treatment selected from among ultraviolet treatment, corona discharge treatment, electron beam treatment, and low- or high-frequency, low-temperature plasma discharge treatment.

6. A biochemical and/or immunological automatic analyzer for receiving a biological sample and a reagent, developing a biochemical and/or immunological reaction between the biological sample and the reagent, and measuring proceedings of the reaction and/or the state at a predetermined point in time by optical means, said reaction container having interior walls in which a liquid is contained and being made of a cyclic polyolefin resin and being used for analysis;

wherein said analyzer includes at least one type of ozone treatment apparatus for performing ozone treatment of a surface of the interior walls of the reaction container, the one type of apparatus being selected from among (1) an apparatus for producing water in which ozone gas is dissolved, (2) an ozone gas sprayer, and (3) an ultraviolet-ozone irradiation apparatus.

* * * * *